US005368065A

United States Patent [19]

Humpert et al.

[11] Patent Number: 5,368,065

[45] Date of Patent: Nov. 29, 1994

[54] LEAK SHIELD FOR RECESSED VALVE

[75] Inventors: Jürgen Humpert, Hemer; Bruno Heimann, Fröndenberg; Harald Dickel, Iserlohn, all of Germany

[73] Assignee: Friedrich Grohe Aktiengesellschaft, Haber, Germany

[21] Appl. No.: 165,077

[22] Filed: Dec. 10, 1993

[30] Foreign Application Priority Data

Dec. 12, 1992 [DE] Germany ..... 4241989

[51] Int. Cl.[5] ..... F16L 5/00

[52] U.S. Cl. ..... 137/377; 137/360

[58] Field of Search ..... 137/360, 377, 381, 312; 251/335.3

[56] References Cited

U.S. PATENT DOCUMENTS

| | | | |
|---|---|---|---|
| 3,495,276 | 2/1970 | Suess . | |
| 3,563,267 | 2/1971 | Thompson | 137/360 X |
| 4,989,633 | 2/1991 | Humpert et al. | 137/360 |
| 5,029,607 | 7/1991 | Blazek et al. | 137/360 |
| 5,046,521 | 9/1991 | Jensen | 137/360 |
| 5,263,510 | 11/1993 | Heimann et al. | 137/359 |
| 5,291,622 | 3/1994 | Humpert | 137/359 X |

FOREIGN PATENT DOCUMENTS

| | | |
|---|---|---|
| 0389814 | 3/1990 | European Pat. Off. . |
| 2339318 | 8/1977 | France . |
| 3209297 | 9/1983 | Germany . |
| 4038418 | 6/1992 | Germany . |
| 635179 | 3/1983 | Switzerland . |

*Primary Examiner*—Martin P. Schwadron
*Assistant Examiner*—Kevin L. Lee
*Attorney, Agent, or Firm*—Herbert Dubno

[57] ABSTRACT

A shield is used in combination with a wall having an outer surface and formed with a throughgoing hole having an edge and with a plumbing fixture almost entirely recessed behind the wall surface and having a control part projecting forward through the hole past the surface. The shield is elastically deformable waterproof and is formed unitarily with a cup-shaped body generally surrounding the plumbing fixture and with an annular bellows-type cuff surrounding the control part and having a rear edge unitarily joined to the body and a front edge fixed to the wall surface at the hole edge. The plumbing fixture also has a laterally projecting connection nipple behind the wall adapted to be mated with a pipe behind the wall and the body is formed with a laterally throughgoing orifice fitted tightly around the nipple. Furthermore the shield is unitarily formed with an annular flange projecting laterally from the front edge of the cuff and fixed to the wall surface at the hole edge.

13 Claims, 2 Drawing Sheets

LEAK SHIELD FOR RECESSED VALVE

FIELD OF THE INVENTION

The present invention relates to a recessed valve. More particularly this invention concerns a shield for a mixing valve of the type mounted in the wall of in a tub or shower enclosure.

BACKGROUND OF THE INVENTION

A mixing valve or the like is typically recessed in a wall, with its supply pipes hidden as well as any outlet pipe leading to a faucet or shower head. The fixture typically has a control part that projects past the surface of the wall where it has a control lever or the like permitting the user to vary the water temperature and/or volume. An escutcheon surrounds the projecting control part and gives the assembly a neat finished appearance.

Thus during construction the fixture is mounted in the wall, typically screwed to a crosspiece fixed between adjacent studs, and the pipes that will be concealed in the wall are connected to nipples on the fixture. Then the inside wall material, typically moisture-resistant gypsum or concrete board, is secured to the studs, after being formed with a rough opening that fits over the projecting part of the fixture. Subsequently the finish material, normally tile or some waterproof sheeting, is adhered to the outer surface of the board, it also forming a rough opening that fits around the fixture's control part. Finally the escutcheon is secured to this control part in tight waterproof contact with the outer surface of the finish material making the completed installation attractive while preventing any water from getting down into the wall.

Such a system offers no problems if executed perfectly. Nonetheless, if there is any irregularity that prevents the escutcheon from seating perfectly, water can get past it and get into the wall. Furthermore during initial installation before the escutcheon is in place or afterward when the valve is being serviced it is possible for some water to get into the wall. When the wall is of standard gypsum-board dry-wall construction, this entry of water into the inside of the structure can be disastrous, leading to structural failure of the wall altogether.

It has been suggested in German patent document 3,723,828 filed Jul. 18, 1987 by J. Humpert et al to provide a cup-shaped foam-plastic insert that surrounds the fixture in the wall. This system serves principally as a sound shield and does little to prevent entry of water into the wall. Furthermore it cannot be adapted readily to installations where the depth at which the fixture is mounted varies beyond very close limits.

OBJECTS OF THE INVENTION

It is therefore an object of the present invention to provide an improved leak shield for a wall-recessed plumbing fixture.

Another object is the provision of such an improved leak shield for a wall-recessed plumbing fixture which overcomes the above-given disadvantages, that is which completely prevents any moisture from getting back into the wall past the fixture and that also can readily adapt to different installation depths.

SUMMARY OF THE INVENTION

The instant invention is a shield used in combination with a wall having an outer surface and formed with a through-going hole having an edge and with a plumbing fixture almost entirely recessed behind the wall surface and having a control part projecting forward through the hole past the surface. The shield is elastically deformable waterproof and is formed unitarily with a cup-shaped body generally surrounding the plumbing fixture and with an annular bellows-type cuff surrounding the control part and having a rear edge unitarily joined to the body and a front edge fixed to the wall surface at the hole edge.

According to a further feature of this invention the plumbing fixture also has a laterally projecting connection nipple behind the wall adapted to be mated with a pipe behind the wall and the body is formed with a laterally throughgoing orifice fitted tightly around the nipple. Furthermore the shield is unitarily formed with an annular flange projecting laterally from the front edge of the cuff and fixed to the wall surface at the hole edge.

Thus it is possible to fit this shield over the plumbing fixture and then mount the fixture in place. When the wall panel is installed, the front edge of the bellows cuff is pulled out and secured to the edge of the hole, preferably by means of the flange. The bellows cuff can accommodate different mounting depths easily while still remaining perfectly waterproof. Thus even if some water does get into the fixture hole, it will not move back into the wall but normally will be directed back out.

According to further features of this invention the flange has a back surface provided with an adhesive adhering it to the wall surface and the flange is formed with an array of perforations. Furthermore, the shield has a Shore A hardness of about 50 and is at least twice as thick at the body as at the cuff. The body has a wall thickness of about 3 mm and is about twice as thick at the orifice that fits around the fixture's connection nipple.

The shield can be made of chlorinated rubber, normally of a closed-cell foam rubber. The body can have a back wall provided with knockouts that can be removed to accommodate screws securing the fixture inside the wall.

BRIEF DESCRIPTION OF THE DRAWING

The above and other objects, features, and advantages will become more readily apparent from the following description, reference being made to the accompanying drawing in which.

SPECIFIC DESCRIPTION

Figure 1B:
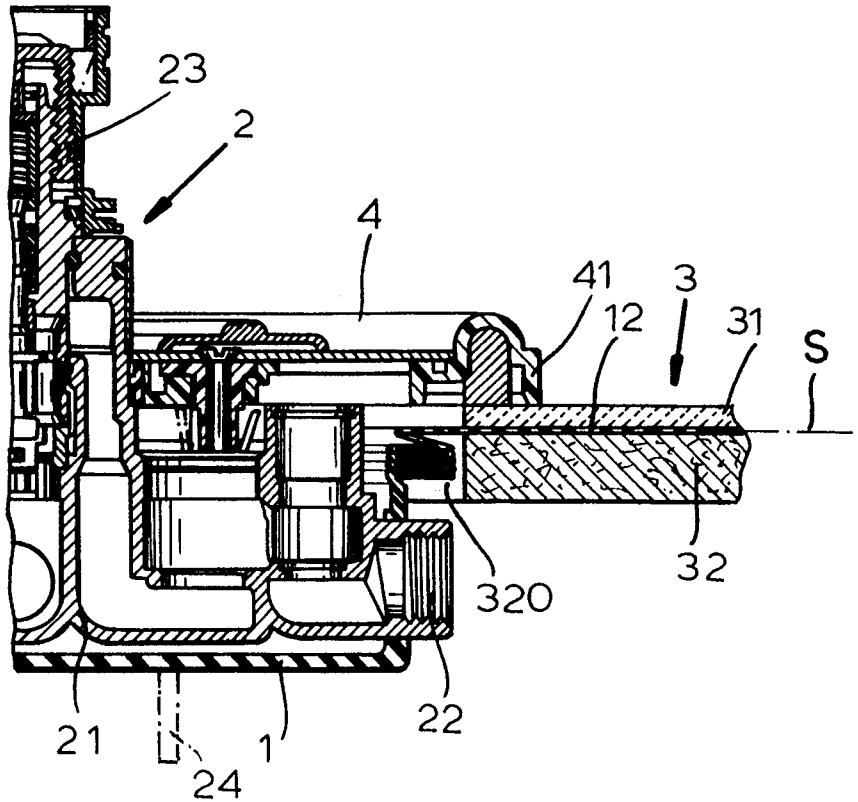
FIGS. 1A and 1B are axial sections through the assembly of the instant invention in deep and shallow installations, respectively.
Figure 1A:
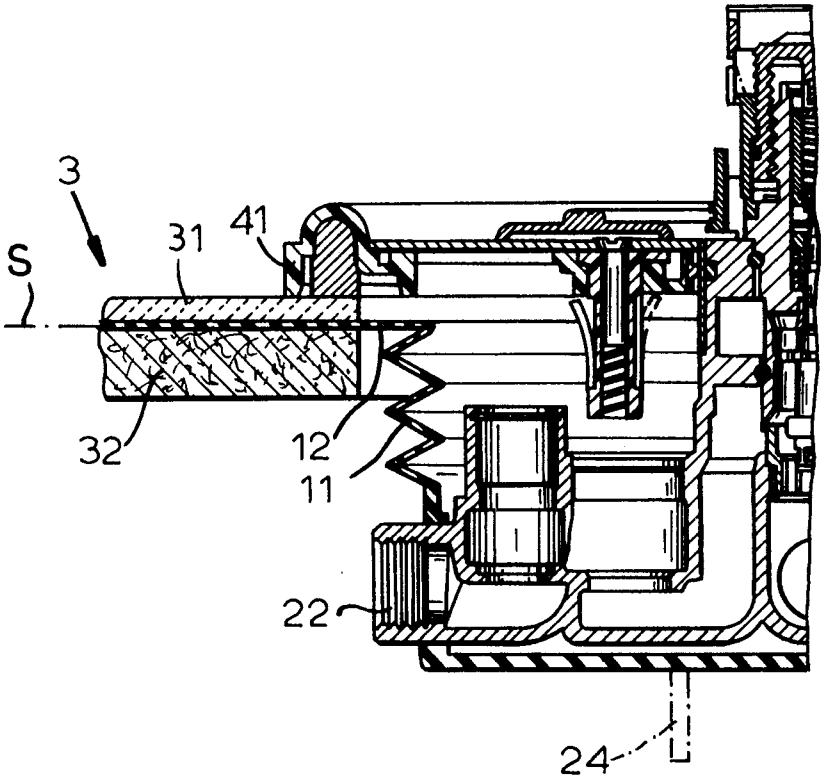

As seen in FIGS. 1A and 1B a plumbing fixture 2 has a body part 21 wholly recessed behind a wall surface S and a control part 23 that projects axially forward well past this surface S. Behind the surface S the body 21 is formed with a plurality of laterally projecting cylindrical and internally threaded connection nipples 22 opening parallel to the surface S. The fixture 2 is a mixing valve and the control part 23 is adapted to carry a handle or lever by means of which flow from two unillustrated hot- and cold-water supply pipes can be diverted to also unillustrated outlet pipes connected to a faucet and/or shower. The supply and outlet pipes are threaded into the nipples 22. Screws 24 may pass through unillustrated mounting ears on the body part 21 to secure it to a support member.

The wall surface S is formed by the vertical front face of a panel 32, here moisture-resistant gypsum board, formed with a generally rectangular rough opening or hole 320 through which the control part 23 projects. The front surface of the gypsum panel 32 is covered by tile 31 in a finished installation.

Figure 2:
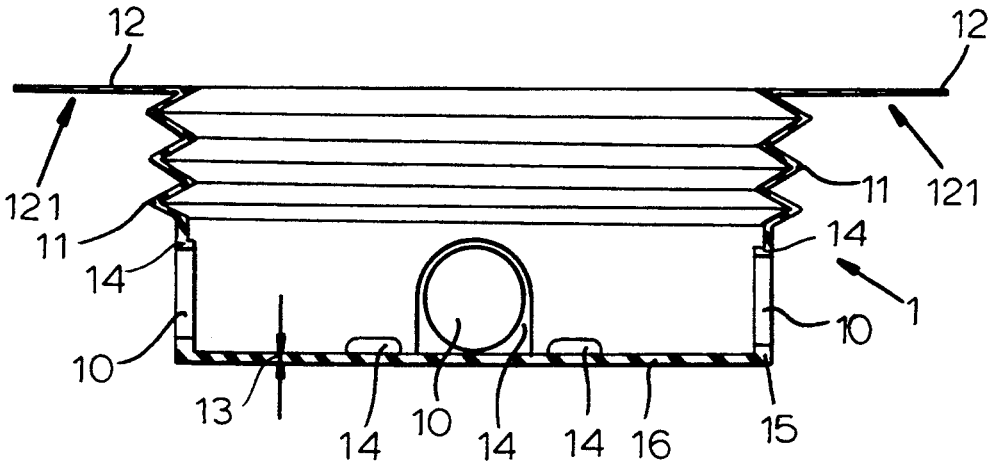
FIG. 2 is a section through the shield of this invention.
Figure 3:
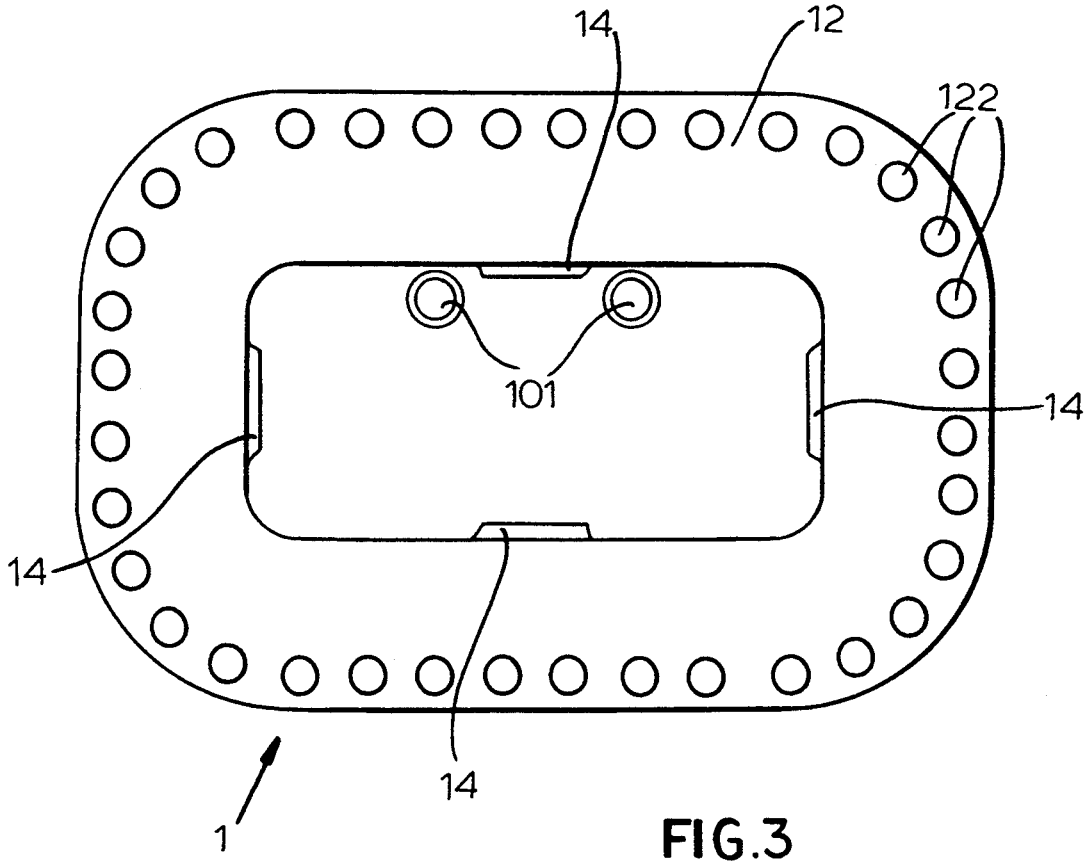
FIG. 3 is a front view of the shield.

According to the invention a chlorinated rubber shield 1 is provided in the hole 320 around the fixture 2. As also seen in FIGS. 2 and 3 this shield 1 has a cup-shaped body 15 with a planar back wall 16, an annular bellows-type cuff 11 whose rear edge is unitary with the front edge of the body 15, and a planar and annular flange 12 whose inner periphery is unitary with the front edge of the cuff 11. The body 15 has a wall thickness 13 of 3 mm but the cuff 11 and flange 12 are only about 1 mm thick for maximum flexibility.

The body 15 is formed with orifices 14 that are of circular shape and dimensioned to fit tightly around the nipples 22. The body 15 is of double thickness at these orifices 14 to ensure a very tight fit. In addition the back wall 16 is formed with knockouts 14 that can be removed to form holes 101 through which the mounting screws 24 pass.

The flange 12 is formed with an annular row of perforations 122. Furthermore its back face has a layer of adhesive 121 normally covered by a removable foil prior to use.

The shield 1 is normally supplied to the installer with the valve fixture 2. It is initially fitted over the valve 2 which is then mounted in the wall and connected up to the supply and outlet pipes.

The panel 32 with the hole 320 is then mounted to the unillustrated studs. Then the flange 12 is pulled out through the hole 320, the cover foil on its back face is stripped off, and it is adhered to the front face of the panel 32 around the hole 320. Then the tile 31 can be installed, with the mastic going through the holes 122 to ensure a very solid mounting.

To finish the installation an escutcheon plate 4 such as described in commonly owned copending applications 07/949,701, U.S. Pat. No. 5,291,622 and 07,968,995, U.S. Pat. No. 5,263,510 respectively filed Sep. 23, 1992 and Oct. 30, 1992 is secured to the fixture 2 with its edge 41 bearing backward tightly against the outer surface of the finish tile 31.

Any water that gets past the escutcheon 4 will not simply run down in the wall, ruining the panel 32, but instead will be trapped by the shield 1 and will normally be forced to run back out the bottom of the shield 1 on the outside face of the wall where it will do no harm. Furthermore if, for instance, the escutcheon has to be removed for replacement of the valve body or other service work, any water that is released will similarly not be allowed down inside the wall.

We claim:

1. In combination a wall having an outer surface and formed with a throughgoing hole having an edge;

a plumbing fixture almost entirely recessed behind the wall surface and having a control part projecting forward through the hole past the surface; and an elastically deformable waterproof shield formed unitarily with a cup-shaped body generally surrounding the plumbing fixture, and an annular bellows-type cuff surrounding the control part and having a rear edge unitarily joined to the body and a front edge fixed to the wall surface at the hole edge.

2. The combination defined in claim 1 wherein the plumbing fixture also has a laterally projecting connection nipple behind the wall adapted to be mated with a pipe behind the wall, the body being formed with a laterally throughgoing orifice fitted tightly around the nipple.

3. The combination defined in claim 1, wherein the shield is further unitarily formed with an annular flange projecting laterally from the front edge of the cuff and fixed to the wall surface at the hole edge.

4. The combination defined in claim 3 wherein the flange has a back surface provided with an adhesive adhering it to the wall surface.

5. The combination defined in claim 3 wherein the flange is formed with an array of perforations.

6. The combination defined in claim 1 wherein the shield has a Shore A hardness of about 50.

7. The combination defined in claim 1 wherein the shield is at least twice as thick at the body as at the cuff.

8. The combination defined in claim 7 wherein the body has a wall thickness of about 3 mm.

9. The combination defined in claim 1 wherein the plumbing fixture also has a laterally projecting connection nipple behind the wall adapted to be mated with a pipe behind the wall, the body being formed with a laterally throughgoing orifice fitted tightly around the nipple and of a wall thickness about twice as great as the wall thickness as the body.

10. The combination defined in claim 1 wherein the shield is made of chlorinated rubber.

11. The combination defined in claim 1 wherein the shield is made of closed-cell foam rubber.

12. The combination defined in claim 1 wherein the body has a back wall provided with knockouts, whereby the knockouts can be removed to mount the fixture inside the wall.

13. In combination a wall having an outer surface and formed with a throughgoing hole having an edge;

a plumbing fixture almost entirely recessed behind the wall surface and having a control part projecting forward through the hole past the surface, and at least one laterally projecting connection nipple behind the wall adapted to be mated with a pipe behind the wall; and an elastically deformable shield formed integrally with a cup-shaped body generally surrounding the plumbing fixture and itself formed with a laterally throughgoing orifice fitted tightly around the nipple, and an annular bellows-type cuff surrounding the control part and having a rear edge unitarily joined to the body and a front edge, and an annular flange projecting laterally from the front edge of the cuff and fixed to the wall surface at the hole edge.

* * * * *